US006610398B1

(12) United States Patent
Koev

(10) Patent No.: US 6,610,398 B1
(45) Date of Patent: Aug. 26, 2003

(54) HAPTIC MATERIALS AND PROCESS FOR PREPARATION

(75) Inventor: Ilia G. Koev, San Diego, CA (US)

(73) Assignee: Biogeneral, Inc., San Diego, CA (US)

( * ) Notice: Subject to any disclaimer, the term of this patent is extended or adjusted under 35 U.S.C. 154(b) by 308 days.

(21) Appl. No.: 09/587,117

(22) Filed: Jun. 2, 2000

(51) Int. Cl.[7] ..... D01F 8/00
(52) U.S. Cl. ..... 428/373; 428/374; 428/370
(58) Field of Search ..... 623/6.56–6.62; 428/370, 373, 374

(56) References Cited

U.S. PATENT DOCUMENTS

| | | | | | |
|---|---|---|---|---|---|
| 4,377,329 | A | | 3/1983 | Poler | 351/160 R |
| 4,571,313 | A | | 2/1986 | Allemand et al. | 264/1.5 |
| 4,657,546 | A | | 4/1987 | Shearing | 623/6 |
| 4,676,791 | A | | 6/1987 | LeMaster et al. | 623/6 |
| 4,718,905 | A | | 1/1988 | Freeman | 623/6 |
| 4,737,322 | A | | 4/1988 | Bruns et al. | 264/1.7 |
| 4,834,754 | A | | 5/1989 | Shearing | 623/6 |
| 4,888,013 | A | | 12/1989 | Ting et al. | 623/6 |
| 4,902,293 | A | | 2/1990 | Feaster | 623/6 |
| 5,085,676 | A | * | 2/1992 | Ekiner et al. | 55/158 |
| 5,121,461 | A | * | 6/1992 | Yamamoto et al. | 385/142 |
| 5,133,746 | A | | 7/1992 | Brady et al. | 623/6 |
| 5,169,569 | A | | 12/1992 | Ingram et al. | 264/2.7 |
| 5,182,053 | A | | 1/1993 | Creasman et al. | 264/1.4 |
| 5,331,073 | A | | 7/1994 | Weinschenk, III et al. | 526/264 |
| 5,397,365 | A | * | 3/1995 | Trentacosta | 623/18 |
| 5,674,284 | A | | 10/1997 | Chang et al. | 623/6 |
| 5,683,456 | A | | 11/1997 | Blake | 623/6 |
| 5,876,442 | A | | 3/1999 | Lipshitz et al. | 623/6 |
| 5,902,530 | A | * | 5/1999 | Jorkasky et al. | 264/78 |

FOREIGN PATENT DOCUMENTS

| | | | | |
|---|---|---|---|---|
| EP | 0 438 043 B1 | | 7/1991 | A61F/2/16 |
| JP | 631218213 | * | 4/1988 | |

OTHER PUBLICATIONS

Ashpole, et al., POE Design Manual/Handbook & Buyers Guide, pp. 6–15, *Reprint from J. of Resrch.*, 8(1), 1993, "Polymer Optical Fibres—A Case Study."

Bahadur, G. and R. Sinsky, http://www.eyeworld.org/feb98/298p09.html, 3 pages, Feb. 1998, "Lessons learned from IOLs."

Emslie, C., *Journal of Materials Science*, 33:2281–2293, 1988, "Review Polymer Optical Fibres."

Haddrill, M., http://www.eyeworld.org/nov99/1199p27.asp, 3 paes, Nov. 1999, "Haptic Designers Explore Innovative Ways to Anchor IOLs."

Nichamin, L., *Ocular Surgery News*, 4 pages, Sep. 1988, "Deciding when foldable IOLs are the right choice."

*Ocular Surgery News*, 2 pages, Feb. 1998, "Acrylic IOL performs well in 7,000 cases by a single surgeon."

*Ocular Surgery News*, 2 pages, Sep. 1996, "Hydogels work well, but different implant technique needed."

*Ocular Surgery News*, 4 pages, Dec. 1999, "More evidence suggests IOL optic material and design can affect PCO."

* cited by examiner

*Primary Examiner*—N. Edwards
(74) *Attorney, Agent, or Firm*—Knobbe, Martens, Olson & Bear LLP

(57) ABSTRACT

Haptic materials and the process for preparation of such materials. The invention described the process to form a fiber comprising a polymer from the class of amorphous thermoplastics with a glass transition temperature sufficiently above temperatures used in standard sterilization techniques, such as steam sterilization and dry heat sterilization. Such a high glass transition temperature provides adequate thermomechanical stability during standard steam sterilization (such as with an autoclave) and dry heat sterilization. Consequently, the haptics made of the thermoplastics described herein do not relax and lose their critical form during heat sterilization. Examples of such thermoplastics are polymers such as polyether sulfone (PES), polysulfone (PSU), polyetherimide (PEI), polyphenylene sulfone (PPSU) or related materials. Moreover, the fiber of this invention offer improved durability and toughness for use as haptics in an intraocular lens (IOL). Stresses imposed during implantation of an IOL impose significant breakage risks on haptics. Thus high strength and flexibility are also major considerations in the preparation of haptic materials.

5 Claims, 7 Drawing Sheets

ASSEMBLED PREFORM

ASSEMBLED
PREFORM

HAPTIC MATERIALS AND PROCESS FOR PREPARATION

BACKGROUND OF THE INVENTION

1. Field of the Invention

The field of the invention relates to a method and apparatus for making fibers and for providing fibers useful as haptics for intraocular lenses.

2. Description of the Related Technology

The replacement of a natural lens with an artificial intraocular lens implant in the human eye has become a well known procedure to physicians specializing in ophthalmology. In the implant procedure, a corneo-scleral incision is made in the eye through which the natural lens is removed and the artificial intraocular lens is inserted. The intraocular lens may be designed to be positioned within either the anterior or posterior chamber of the eye.

Intraocular lenses typically include a central lens section, referred to as the optic, which focuses light onto the retina, and one or more supporting structures, called haptics which extend outward from the optic to align and stabilize the optic on the pupillary axis. Typically haptics comprise one or more filamentous arms or loops extending radially outwardly from the periphery of the optic. The haptics locate within the eye by engagement with predetermined ocular tissues.

Intraocular lenses are typically of two types: a three-piece lens where two haptics are mechanically fixed to the lens optic, and a one-piece lens where the haptics and optic are made as a single unit.

For both one-piece and three-piece lenses conventional practice is to construct the optic of a hard biocompatible polymer, such as polymethylmethacrylate (PMMA). More recently, innovations in optically clear elastomeric materials have allowed construction of lens which can be folded or rolled and inserted through very small incisions. Small incision surgery is thought to reduce trauma and the likelihood of complications.

Installation of an intraocular lens should be permanent so that subsequent surgical adjustments are not required. Accordingly, the reliability of the haptic is of great importance. The materials of construction and the design parameters must be selected such that the haptic can endure significant stresses with minimum risk of breakage. Moreover, the haptic must be capable of functioning safely in the presence of small stress risers, such as notches or nicks, which may be inflicted during manufacture and surgical handling and manipulation.

Unfortunately, haptics often develop clusters of fractures, referred to as craze, when subjected to impact and bending forces during handling. If the individual craze fractures are large enough to extend across a significant portion of the shaft diameter, a broken haptic results.

Therefore, it is critical that the haptic of the lens exhibits significant resistance to breakage during use. Although certain haptic materials such as polypropylene used in construction of a three-piece lens offer acceptable resistance to breakage, other conventionally used haptic materials such as PMMA are brittle and more frequently prone to breakage. This problem becomes especially acute when the haptics are lathe cut from a single lens blank to prepare a one-piece lens with integrally attached haptics. The problem of haptic breakage is a serious one, and efforts have been made to provide the haptics with increased breakage resistance.

Several thermoplastic forming techniques have been used to induce orientation in the material in order to impart enhanced mechanical properties in PMMA intraocular lens haptics. One such effort is described in U.S. Pat. No. 5,169,569. This patent describes preparing intraocular lenses with haptics exhibiting greater ductility and fatigue resistance. The PMMA sheet plastic is modified by means of blowing the sheet into a hemispherical bubble followed by forming into a flattened circular portion.

Another effort is disclosed in European Patent Application 0 438 043 A2. The PMMA material is modified by multi-axis stretching, to produce haptics with increased tensile strength, flexibility and resilience. A further example is described in U.S. Pat. No. 5,674,284 where a one-piece intraocular lens with fracture resistant haptics is disclosed.

Nevertheless, these and other conventional methods have not ideally solved the problem of creating a flexible yet durable intraocular lens. In general, the conventional one-piece lens is often too brittle and can break upon insertion. The three-piece lens, while in some cases offering more durability and flexibility, is generally comprised of materials that are prohibitive to efficient sterilization techniques.

It is necessary to sterilize each lens before insertion. Ethylene oxide is currently the most commonly used method of IOL sterilization. Environmental concerns with ethylene oxide release and concerns regarding removal of trace amounts of ethylene oxide and its ethylene glycol byproducts from the sterilized IOL and its package have caused the industry to seek other sterilization methods.

However, the conventional three-piece lens relies on materials which can be damaged during standard steam sterilization and dry heat sterilization techniques. The problem with both steam sterilization and dry heat sterilization methods has been inadequate thermomechanical stability of the formed haptic parts of the sterilized lens assembly. The haptics made of conventional materials relax and lose their heat set configuration during heat sterilization. This problem is particularly acute with elastomeric lenses. Lens manufacturers have resorted to so called "dry transfer" sterilization methods for elastomerics wherein they sterilize the lens components separately, assemble the lens in a sterile field and transfer the assembly to a sterile saline solution-containing package. This method is expensive, potentially unsafe and is in general deplored by health authorities.

Accordingly, there is a need for an intraocular lens having haptics which are tough and flexible allowing for proper insertion and retention. Moreover, there is a need for an intraocular lens haptic filament which is not only tough and flexible but also thermomechanically stable to allow for safer and less costly sterilization techniques.

SUMMARY OF THE INVENTION

One aspect of the invention is directed to a method for manufacturing a fiber, the method comprising forming a fiber having a first level of orientation from an amorphous thermoplastic with a glass transition temperature above approximately 160° C. and inducing a second level of orientation on the fiber, wherein the second level of orientation is of a higher degree of orientation than the first level of orientation. Forming of the fiber can occur in a controlled environment at a certain temperature and inducing the second level of orientation on the fiber can occur in a controlled environment at a second certain temperature. Specifically, the fiber can be formed from a fiber from a polymer selected from the group consisting of polyether sulfone (PES), polysulfone (PSU), polyetherimide (PEI), and polyphenylene sulfone (PPSU). The high glass transition temperature permits use of standard sterilization techniques, steam sterilization and dry heat sterilization, for the fiber. Consequently, the fiber is well suited for use as a haptic for an intraocular lens (IOL) which requires sterilization but also requires tough materials.

Forming of the fiber can include preparing a preform comprising the amorphous thermoplastic and melt drawing the preform to form the fiber in a controlled environment at a certain temperature. Alternatively, forming the fiber can comprise extruding the amorphous thermoplastic to form the fiber.

The preform can be prepared by casting the amorphous thermoplastic into a form of a cylindrical rod and machining the cylindrical rod to smooth the surface of the cylindrical rod. The casting can include casting the thermoplastic into a colored cylindrical rod and casting the thermoplastic into an outer tube, wherein the cylindrical rod is inserted into the outer tube to form the preform.

Inducing the second level of orientation on the fiber can comprise heating the fiber in a controlled environment at a certain temperature and tensioning the fiber. Once a second level of orientation has been induced on the fiber, the fiber can be cut into lengths suitable for use as a haptic and then the lengths can be formed into shapes suitable for use as a haptic.

Another aspect of the invention is directed to an intraocular lens which includes a lens body and a haptic attached to the lens body, wherein the haptic is formed from a fiber comprising the thermoplastic described above. The lens body of the intraocular lens can be foldable, hydrophilic, or hydrophobic.

Another aspect of the invention is directed to a system for manufacturing the fiber which can be used as a haptic in an IOL. The system can comprise a preform drawing machine configured to form the fiber from a preform comprising the thermoplastic and a tensioning device configured to induce a greater level of orientation on the fiber.

These and other aspects, advantages, and benefits of the invention will become apparent upon review of the following detailed description and appended drawings.

DETAILED DESCRIPTION OF THE PREFERRED EMBODIMENTS

Figure 1:
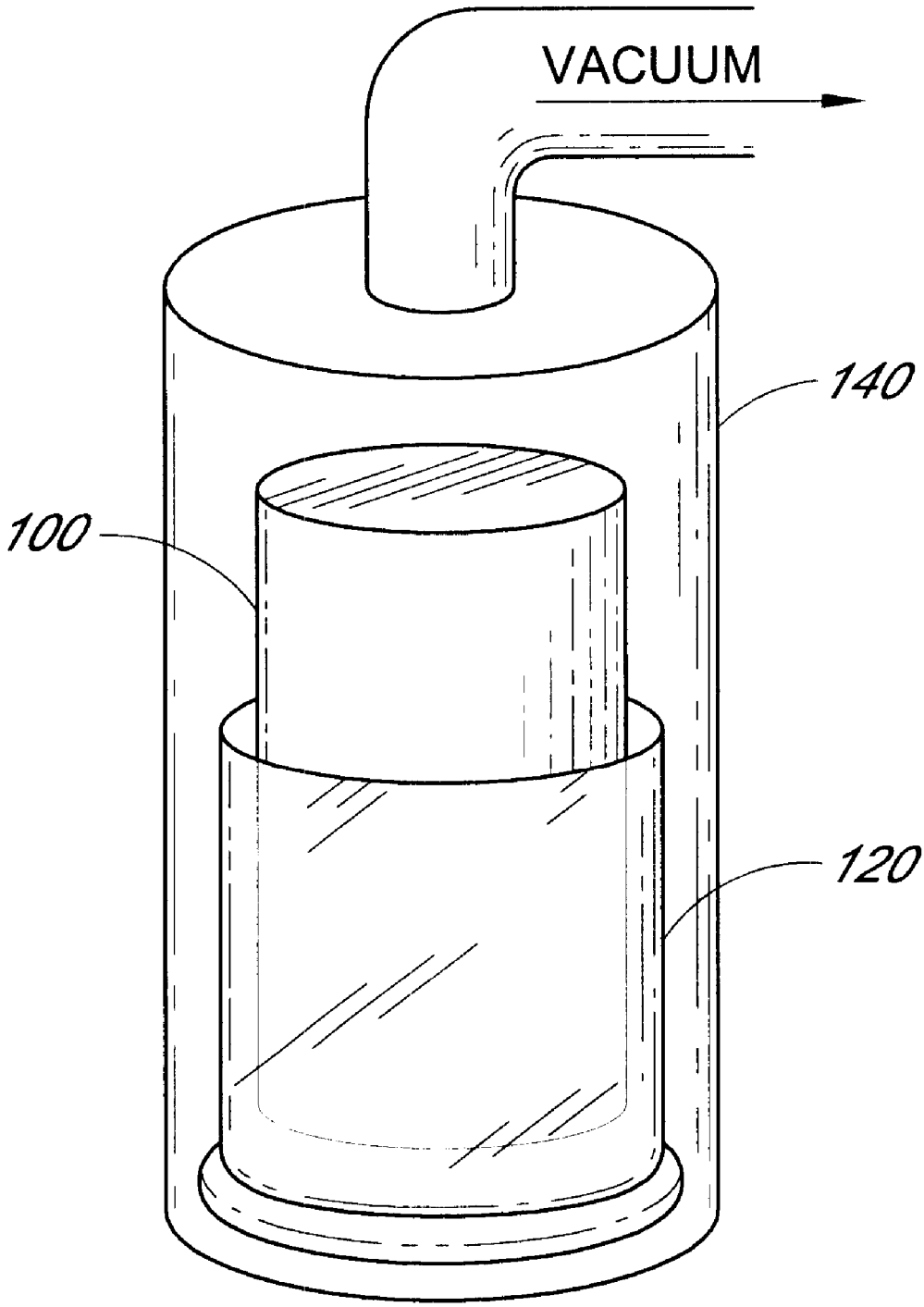
FIG. 1 is a perspective view of a preform casting apparatus.

The materials described herein can be used in haptic applications for an intraocular lens (IOL). Instead of using the conventional PMMA polymer to manufacture a fiber which can be used for a haptic, polymers from the class of amorphous thermoplastics with a glass transition temperature sufficiently above temperatures used in standard heat sterilization techniques, such as steam sterilization and dry heat sterilization are used (hereinafter referred to as "the thermoplastic"). For example, depending on the specific application or the intended use of the fiber, suitable glass transition temperatures include approximately 160° C., 165° C., 170° C., 175° C., 180° C., 185° C., 190° C., 195° C., 200° C., 205° C., 210° C., 215° C., 220° C., 225° C., 230° C., 235° C., and 240° C. Such a high glass transition temperature provides adequate thermomechanical stability during standard steam sterilization (such as with an autoclave) and dry heat sterilization. Consequently, the haptics made of the thermoplastics described herein do not relax and lose their critical form during heat sterilization. Examples of such thermoplastics are polymers such as polyether sulfone (PES), polysulfone (PSU), polyetherimide (PEI), polyphenylene sulfone (PPSU) or related materials, as will be more fully described below.

Polyether sulfone is commonly known as PES, also designated as PESV in ASTM D 400, "Standard Classification System for Specifying Plastic Materials." An example of PES which can be used is Ultrason™ E 3010 Natural with a supplier-defined melt flow rate of 360/10 (ASTM 1238) 48 g/10 min. Other forms of PES, PSU, PEI, and PPSU can also be used. These inherently strong and tough engineering polymers can be processed according to the methods described below in order to provide a preferential polymer orientation, resulting in greatly increased resistance to breakage.

Using known melt drawing processes (hereinafter referred to as "preform drawing") to form fiber from the thermoplastic preform can impart some degree of preferential polymer orientation. However, PES and other high temperature amorphous polymers (such as PSU, PEI, and PPSU) can be processed to a higher degree of orientation by a method used in conventional textile industry melt spinning. This secondary orientation is tightly controlled by the temperature and the tension applied to the fiber. This results in a highly oriented fiber exhibiting excellent toughness, flexibility and thermomechanical stability. In addition, such fibers demonstrate mechanical stability when sterilized using standard techniques such as steam sterilization at temperature of 121° C./15 psi and dry heat sterilization at 160° C.

The methods described below for manufacturing haptic filaments for IOLs from the thermoplastic generally can be divided into four parts: (1) fiber formation by preform drawing of the thermoplastic, (2) orientation of the thermoplastic fiber, (3) thermoformation of the cut, oriented thermoplastic fiber into a haptic, and (4) attachment of the formed haptic filament to the IOL. It should be understood that instead of using both preform drawing and fiber drawing, these fibers may be made entirely or partially by extrusion techniques or by high speed melt spinning which yields highly oriented fiber. However, using both melt preform drawing and secondary orientation through fiber drawing can provide for tighter control of the final mechanical properties and diameter of the finished product.

Fiber Formation by Preform Drawing

Preform drawing processes are known in the art. An example of a typical preform drawing process is shown in U.S. Pat. No. 4,571,313 hereby incorporated by reference. Before the drawing process begins, preparation of the thermoplastic preform occurs.

This preparation of the preform can generally include the following aspects: (1) casting, (2) machining, and (3) fitting.

The casting step is depicted in FIG. 1. In the casting step, a dry resin comprising the thermoplastic is placed in a vessel 120. The resin can be either clear or colored with a pigment. The vessel 120 is then placed in an oven 140 and a vacuum is applied for 24 to 48 hours. The temperature of the oven 140 is then increased from room temperature to the thermoplastic melting temperature. The chamber of the oven 140 is maintained at the thermoplastic melting temperature for 6 to 12 hours, whereupon the vacuum 150 is replaced by dry nitrogen pressured to 2–5 psi. for 3 to 6 hours. Subsequently, the temperature of the oven is lowered to room temperature over a period of 12 to 24 hours.

Note that alternatively extrusion and ram-extrusion methods by which resin consolidation can be accomplished somewhat similar to the result of the casting method described above can also be used.

Like haptics made from PMMA, the haptics manufactured from the materials described herein can be colored using conventional coloring techniques known in the art. Practitioners inserting haptics typically prefer certain coloring schemes to aid in manipulation of these tiny fibers. For example, a transparent outer sheath can enclose a colored inner core of the fiber (such as a blue core preferred by many practitioners in this field). The materials described herein permit the use of these conventional coloring methods.

Figure 2:
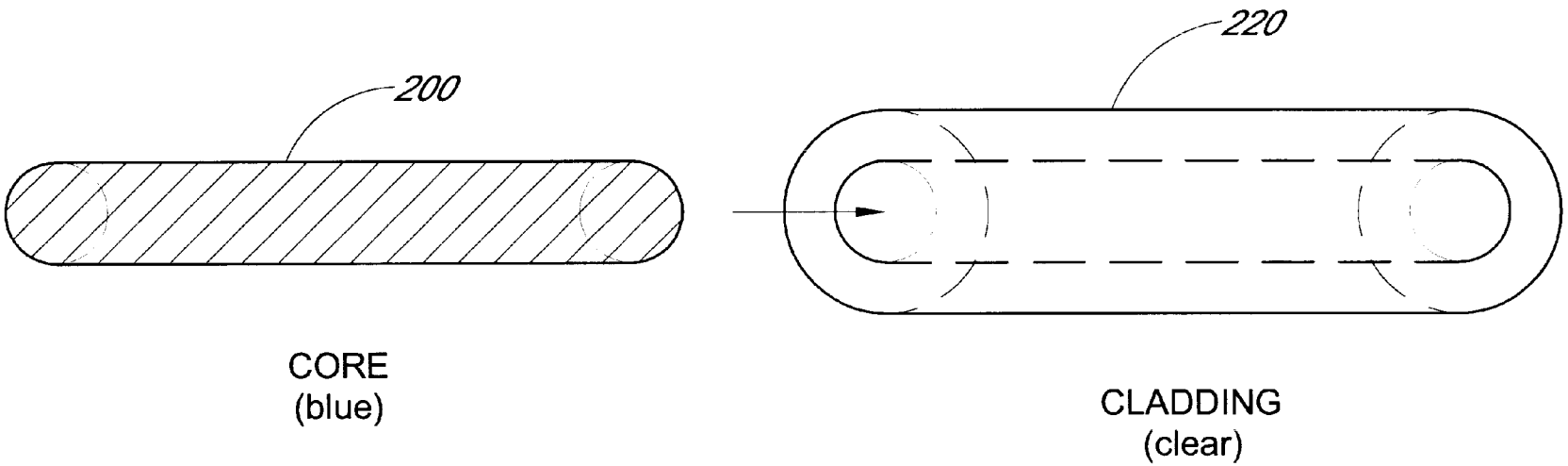
FIG. 2 is a perspective view of a preform assembly.

In the machining step, the cast rods are removed from their melting vessels and then machined with a lathe. For reasons described above, color can be added prior to casting of the thermoplastic using standard pigment coloring techniques. As a result, for example, one cast rod can be colored blue and other cast rod can remain in its transparent natural state. The blue rod can then be machined into a smooth cylindrical rod 200 and the clear rod can be bored to produce a tube 220 as shown in FIG. 2. The diameter of the rod 200 is typically machined to be 0.2 to 1.0% larger than the inner diameter of the tube 220.

Figure 3A:
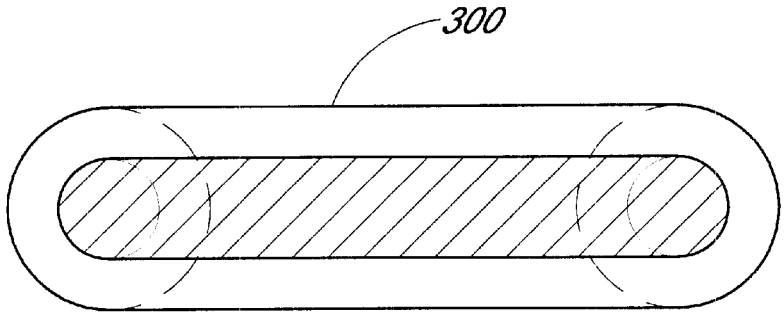
FIG. 3A is a perspective view of a preform.
Figure 3B:
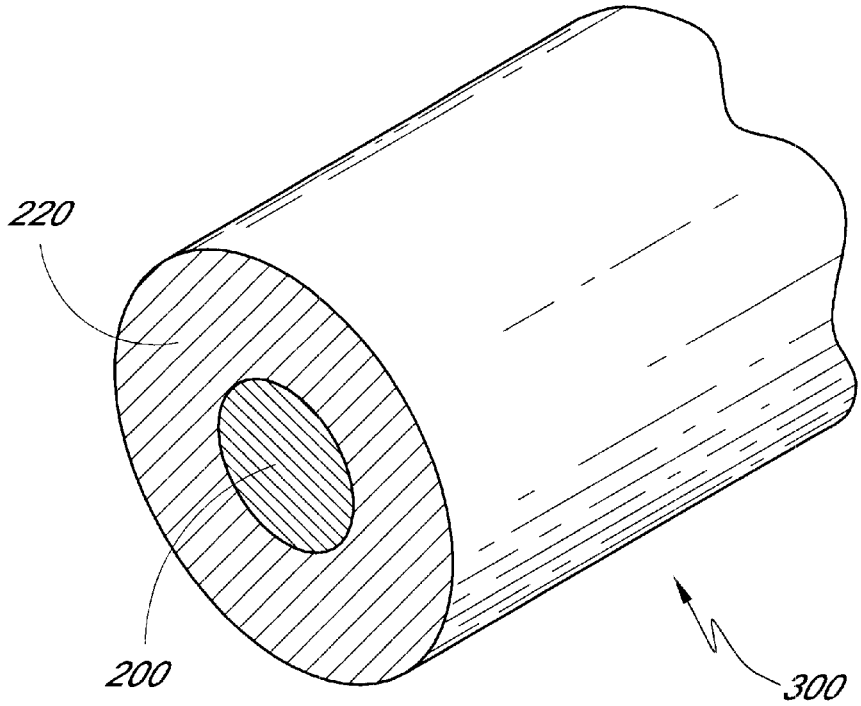
FIG. 3B is a cross-section view of the preform of FIG. 3A.

In the fitting step, the tube 200 is placed into a vessel. The vessel which is placed in an oven at a temperature up to 150–200° C. The hot tube 220 is then removed from the oven and the vessel. The rod or core 200 is inserted into the tube or cladding 220 at room temperature. The tube 220 cools and shrinks into intimate contact with the rod 200. This tube 220 and rod 200 configuration (core-cladding) forms the preform 300 as shown FIGS. 3A and 3B. FIG. 3B provides a cross-section view of the preform 300. Alternatively, the preform can be one piece or more than two pieces.

Figure 4:
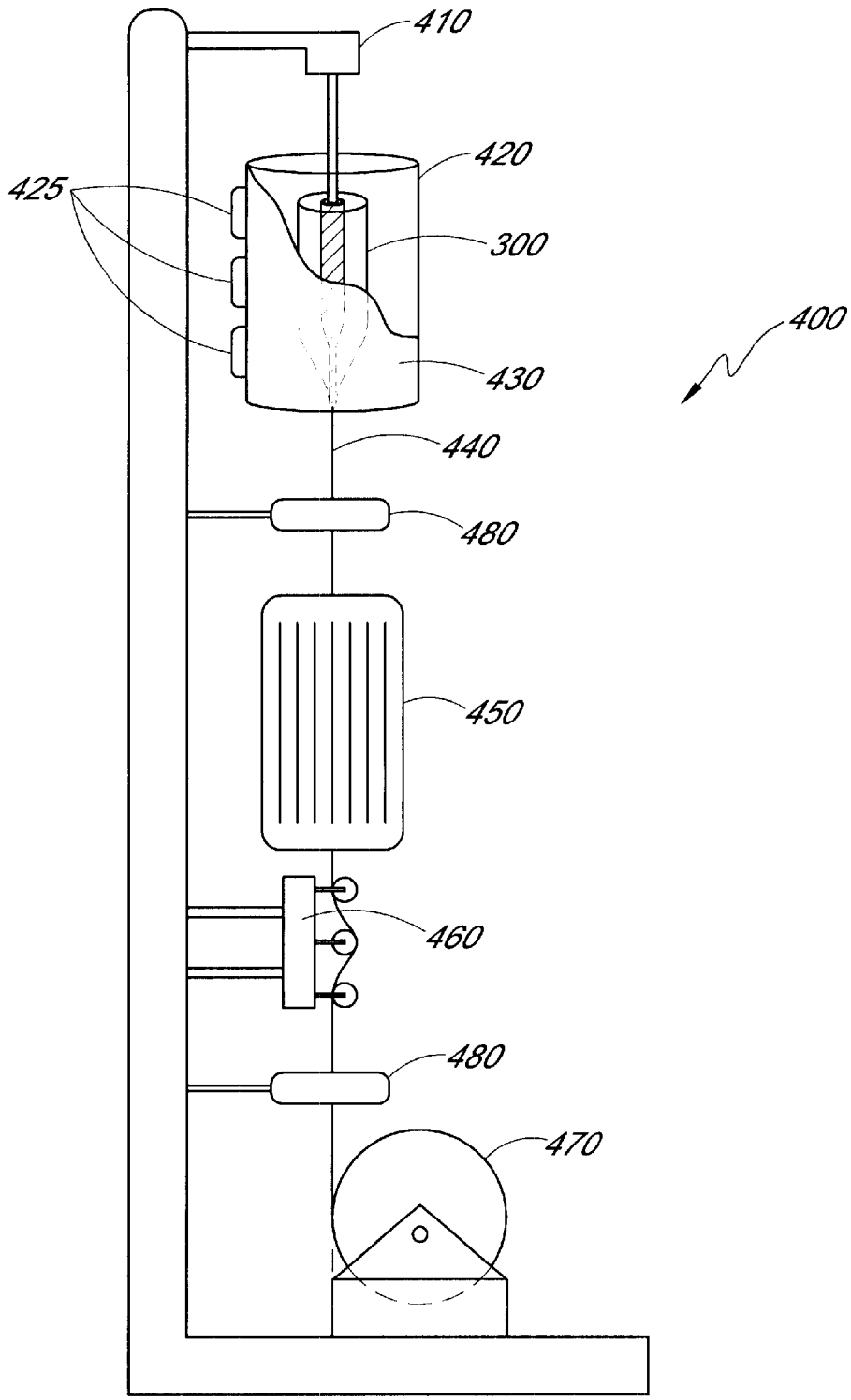
FIG. 4 is a perspective view of a preform drawing apparatus.

Referring to FIG. 4, after the three steps of the preparation of the preform 300 are completed, the preform 300 is then attached to a positioning device 410 of the preform drawing apparatus 400. A furnace 420 is position beneath the positioning device 410 and consists of a heating element or elements 425 fixed in a glass envelope 430. The preform 300 is rotated at approximately 0.1 to 1.1 rpm in order to compensate for radial variation of the furnace 420 inner surface temperature. The preform 300 is lowered into the furnace 420 and heated at approximately 320–360° C. and is then lowered further into a region of the furnace 420 maintained at approximately 120–260° C. The preform 300 begins to melt into a fiber 440 which flows from an opening in the vessel induced by gravity. The emerging fiber 440 is passed through a refrigerated tube 450 maintained at −20° C. Next, the fiber 440 is guided through the wheels of a laser micrometer 460 with a tension gage. The fiber 440 is then attached to a take-up drum 470. The temperature of the hot section of the furnace 420 is adjusted to maintain 1 to 50 grams of take-up tension and the speed of the take-up drum 470 is adjusted to maintain required fiber diameter. One or more fiber measurement lasers 480 can be used to measure the fiber 440 throughout the process. The specific temperature or temperature ranges, the take-up tension, and the other variables of the preform drawing process used can be varied according to the characteristics of the thermoplastic used and the dimensions the preform 300 as is known by those of ordinary skill in the art.

Exemplary results of PES preforms subjected to the drawing process are described below:

EXAMPLE 1

A core-cladding structure PES, Ultrason E 3010, preform was subjected to a fiber formation drawing process. The core of the preform was made out of PES doped with 0.44 wt % of {Phthalocyaninato (2-)] copper and the cladding was made out of 100% PES. The ratio of the core-cladding diameters was 2:1. More specifically, the preform above was drawn at temperature of 320° C. into a fiber with diameter of 0.0086". The drawing tension used herein was 5.3 g. The elongation of the prepared fiber was 220% and the tensile strength was 17343 psi.

EXAMPLE 2

A core-cladding structure PES, Ultrason E 3010, preform was subjected to a fiber formation drawing process. The core of the preform was made out of PES doped with 0.44 wt % of {Phthalocyaninato (2-)] copper and the cladding was made out of 100% PES. The ratio of the core-cladding diameters was 5:2. More specifically, the preform above was drawn at temperature of 340° C. into a fiber with diameter of 0.0089". The drawing tension used herein was 3.1 g. The elongation of the prepared fiber was 205% and the tensile strength was 18,205 psi.

Orientation of the Thermoplastic Fiber

Figure 5:
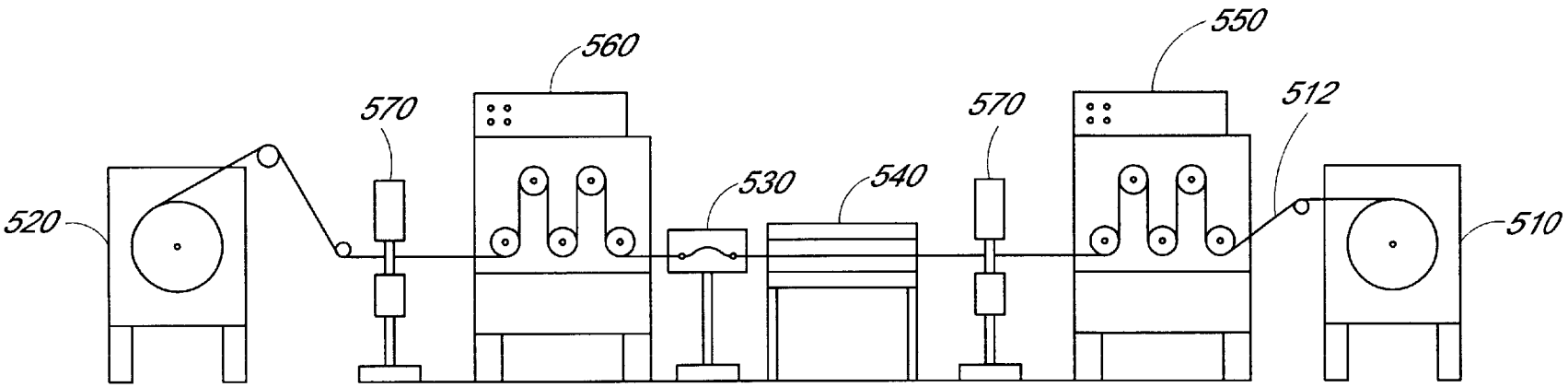
FIG. 5 is a perspective view of a fiber drawing apparatus.

Primary orientation is provided by the preform drawing process. The degree of primary orientation depends on the material and various preform drawing parameters, such as tension and temperature. Fiber manufactured by the preform drawing process has some primary degree of orientation and residual elongation that can only be removed by a secondary fiber drawing. Therefore, in order to achieve the optimal characteristics of the thermoplastic, the fiber is secondarily oriented by a commonly used textile industry apparatus as shown in FIG. 5. The secondary fiber drawing process causes the previously relatively randomly arranged, non-oriented chain molecules to be drawn into ordered longitudinal axis structures.

The optimal fiber drawing temperature is just below the polymer glass transition temperature. The apparatus as shown in FIG. 5 heats and stretches the drawn fiber to mobilize its structure and allow the fiber to stretch into optimal orientation. The total degree of orientation or strain rate is determined by temperature, line speed and tension. As shown in FIG. 5, an unwind stand 510 and a winding stand 520 maintain tension of the fiber 512. A tension measurement device 530 measures this tension after heating by a heater 540. Two godet rolls, godet roll 1 550 and godet roll 2 560, are used to accomplish the secondary fiber drawing process. One or more fiber measurement lasers 570 can be used to measure the fiber throughout the process. The speed of godet roll 2 is determined by a continuously calculated formula using line speed, tension and diameter measurements as determined by a fiber measurement laser 570.

Exemplary results of the orientation process are described below:

EXAMPLE 3

The PES fiber produced in example 1 was drawn down to 0.0059" at temperature of the heaters of 180° C. Godet Roll 1 and Godet Roll 2 line speeds were 82.46 feet per minute and 140.19 feet per minute respectively, for a drawn down ratio of 1.21. The fiber production was removed from the take-up by cutting with a razor blade in 2.5 ft long pieces. The elongation of the fiber prepared in this manner was 34.7% and tensile strength was 37,787 psi.

EXAMPLE 4

The PES fiber produced in example 2 was drawn down to 0.0063" at temperature of the heaters of 185° C. Godet Roll 1 and Godet Roll 2 line speeds were 82.46 feet per minute and 158.06 feet per minute respectively, for a drawn down ratio of 1.19. The fiber production was removed from the take-up by cutting with a razor blade in 2.5 ft long pieces. The elongation of the fiber prepared in this manner was 32.7% and tensile strength was 39,910 psi.

Thermoformation of the Fiber into a Haptic

The thermoplastics are aromatic, amorphous, polymeric materials. They combine high thermal stability with mechanical strength and toughness. These characteristics result from the chemical structure of these engineering polymers. The presence of sulfone groups and/or ether bonds determines their long-term load-bearing capability and high glass transition temperature. The fact that this temperature is much higher than the steam and heat sterilization conditions is important for the IOL haptic application. Typically, thermoplastics are formed at temperatures around their glass transition temperatures. High glass transition temperature of these materials confers post heat sterilization stability. For example, the glass transition temperatures of the thermoplastics are:

| Polymer | Glass Transition Temperatures |
|---|---|
| PES | 220° C. |
| PPSU | 220° C. |
| PEI | 217° C. |
| PSU | 190° C. |

These combination of properties makes the thermoplastic especially suited for application as a haptic for an IOL. As an example of these improved characteristics, a comparison of the mechanical properties of a PES haptic and a PMMA haptic is presented in Table 1 below. While the compression force results show insignificant differences, PES has a superior tensile strength performance.

TABLE 1

| | PES | PMMA |
|---|---|---|
| Tensile strength, psi | 38,693 | 12,893 |
| Elongation, % | 32.7 | 54.7 |
| Compression Force in mg, @ 0.25 mm | 32 | 29 |
| Compression Force in mg, @ 0.50 mm | 59 | 62 |
| Compression Force in mg, @ 1.00 mm | 96 | 100 |

Figure 6:
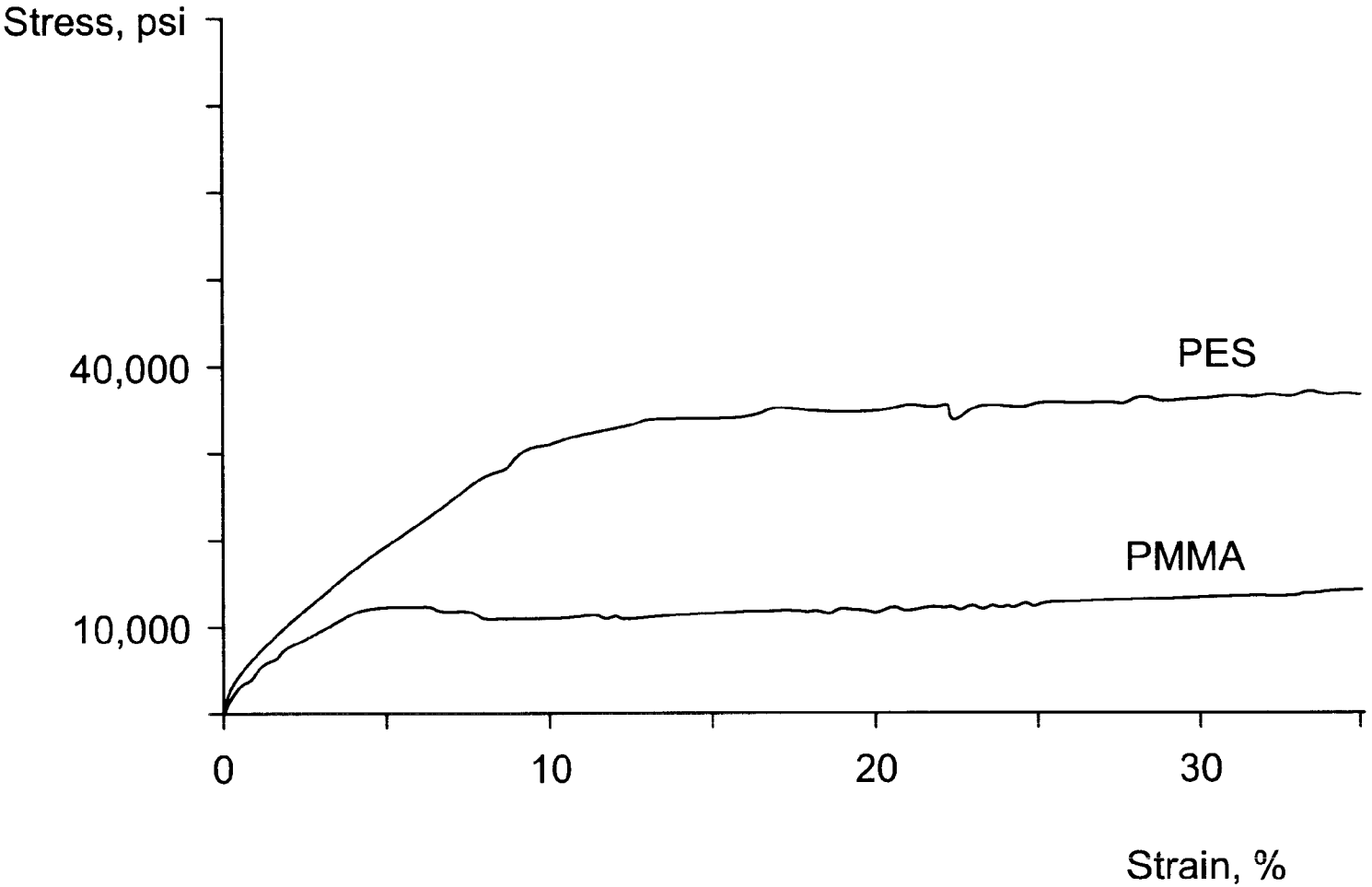
FIG. 6 is a stress-strain curve for polymethylmethacrylate (PMMA) and polyether sulfone (PES).

Most, if not all, fracture of engineering materials is initiated at pre-existing flaws, commonly called stress risers. A tough material resists the propagation of flaws through processes such as yield and plastic deformation. Because fracture involves both tensile strength and plastic deformation, or strain, the stress-strain curve can be used to estimate material toughness. The area under a stress-strain curve (normalized to specimen dimensions) is a measure of the energy absorbed by the material during a tensile test. From this standpoint, this area is a rough estimate of the toughness of the material. A comparison of the stress-strain curves for PES and PMMA is shown in FIG. 6.

In general, haptics can be in a variety of shapes and sizes for use with an IOL. The most common shapes are J-loops, S-loops and C-loops. All common methods applicable to PMMA and polypropylene fibers for forming the fiber into shapes suitable for use as haptics for an IOL are equally applicable to the fibers manufactured from the thermoplastic. As an example, the fiber prepared in Example 3, above, could be formed into a C-shape using one such common method. The fiber can be wrapped around a C-shape fixture. A pulling force sufficient to wrap the fiber with adequate conformity can then be applied. The fixture can be placed into an air convection oven and the temperature can be raised to 220° C. After a period of time, such as sixty minutes, the fixture is taken out of the oven and the heated fiber is removed. The fiber is then cut into C-shape haptics.

Attachment All common attachment methods applicable to PMMA and polypropylene haptics for securing the haptic fiber to the IOL are equally applicable to the haptics manufactured from the thermoplastics. As examples, the haptic can be attached to the IOL by melting the haptic to the lens body, by securing the haptic to the lens body with adhesive, or by inserting one end of the haptic into a corresponding hole in the lens body. Epoxy based adhesives such as EP HT, EP21LV and EP30 supplied by Master Bond, Inc., for example, are suitable in bonding these materials.

Figure 7:
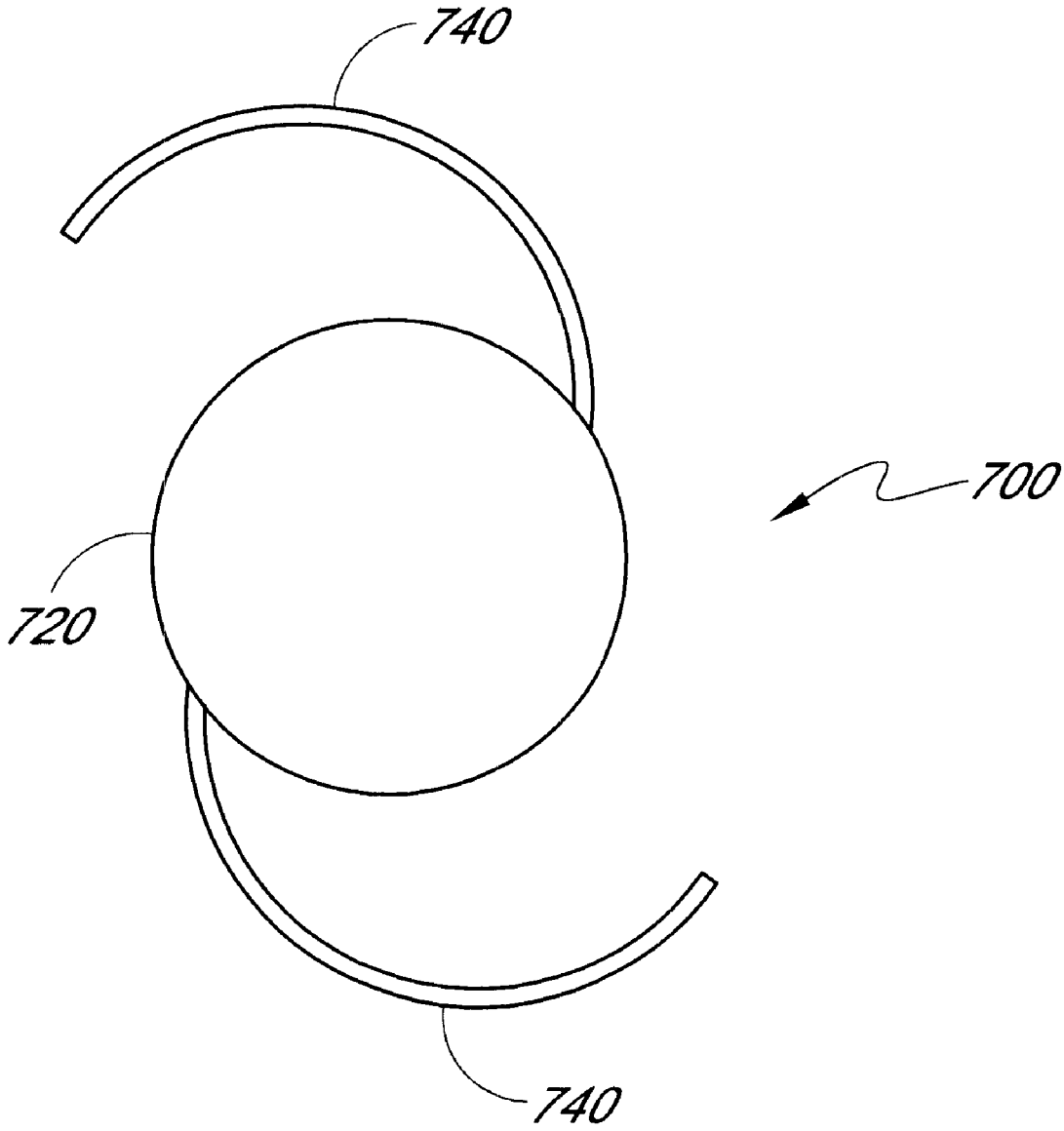
FIG. 7 is a top view of a three-piece intraocular lens having haptics.

The haptics made according to this invention can be attached to form a typical three piece intraocular lens 100 as illustrated in FIG. 7. FIG. 7 shows an optic or lens body 720 suitably shaped for proper focusing according to methods well-known to those practicing in the field of intraocular lens manufacture. The lens body 720 can be formed from various materials known by those of ordinary skill in the art including those materials described herein. For example, the lens body 720 can be foldable, hydrophilic, or hydrophobic. The lens body 720 has supporting elements or haptics 740 extending therefrom. The lens body 720 may be bi-convex, or plano-convex, concave-convex or any other optical configuration as desired. The optic may also have refractive and diffractive optic portions, several refractive curves or an aspheric surface to give bifocal or multifocal capabilities.

In some embodiments of lenses of this type, the lens body 720 can be approximately 4 to 7 mm in diameter, with the haptics 740 extending outwardly to create an overall size of between approximately about 9 and 14 mm. As is well known in the art, forces exerted on the haptics 740 create high stress at the junction between the haptics 740 and the lens body 720 from which the haptics 740 are generally cantilevered. Stresses imposed during implantation impose another breakage risk on haptics. Thus high strength and flexibility are major considerations. Therefore, fibers manufactured from the thermoplastic are well suited for haptics in IOLs.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention.

What is claimed is:

1. A co-axial fiber comprising:

a cladding comprising a polymer selected from the group consisting of polyether sulfone (PES), polysulfone (PSU), polyetherimide (PEI), and polyphenylene sulfone (PPSU); and an inner core comprising said polymer doped with a pigment.

2. The co-axial fiber of claim 1 in which said polymer is polyether sulfone.

3. The co-axial fiber of claim 1 in which said inner core is blue.

4. The co-axial fiber of claim 1 in which said pigment is phthalocyaninato (2-) copper.

5. The co-axial fiber of claim 1 having a ratio of core-cladding diameters in the range of 2:1 to 5:2.

* * * * *